US005092744A

United States Patent [19]

Boers et al.

[11] Patent Number: 5,092,744

[45] Date of Patent: Mar. 3, 1992

[54] INTENSIFIER

[75] Inventors: Arie Boers, Plymouth; Eric J. Chalmers, Minneapolis, both of Minn.

[73] Assignee: Possis Corporation, Minneapolis, Minn.

[21] Appl. No.: 493,422

[22] Filed: Mar. 14, 1990

[51] Int. Cl.[5] ..... F04B 1/28; F04B 39/10

[52] U.S. Cl. ..... 417/397; 91/275; 91/277; 137/533.21; 417/569

[58] Field of Search ..... 91/275, 277; 417/397, 417/569; 137/533.21, 454.4

[56] References Cited

U.S. PATENT DOCUMENTS

| | | | |
|---|---|---|---|
| 592,235 | 10/1897 | Campbell | 137/533.21 X |
| 635,271 | 10/1899 | Scott et al. . | |
| 825,924 | 7/1906 | Moore . | |
| 1,073,954 | 9/1913 | Burns . | |
| 1,386,567 | 8/1921 | Hafstrom | 417/569 |
| 2,000,805 | 3/1932 | West et al. . | |
| 2,612,951 | 10/1952 | Palmleaf . | |
| 2,942,584 | 6/1960 | Rethmeier . | |
| 3,045,611 | 7/1962 | Murray . | |
| 3,077,838 | 2/1963 | Maglott | 417/397 X |
| 3,106,169 | 10/1963 | Prosser | 417/569 X |
| 3,520,477 | 7/1970 | Cooley . | |
| 3,521,820 | 7/1970 | Cooley . | |
| 3,540,349 | 11/1970 | Pennther . | |
| 3,565,191 | 2/1971 | Bowen . | |
| 3,700,360 | 10/1972 | Shaddock . | |
| 3,771,912 | 11/1973 | Conlee | 417/397 |
| 3,811,795 | 5/1974 | Olsen . | |
| 3,997,111 | 12/1976 | Thomas et al. . | |
| 4,026,322 | 5/1977 | Thomas . | |
| 4,119,113 | 10/1978 | Meginniss, III . | |
| 4,216,906 | 8/1980 | Olsen et al. . | |
| 4,313,570 | 2/1982 | Olsen . | |
| 4,380,138 | 4/1983 | Hofer . | |
| 4,412,792 | 11/1983 | La Borde et al. | 137/454.4 X |
| 4,862,911 | 9/1989 | Yie . | |

*Primary Examiner*—Gerald A. Michalsky
*Attorney, Agent, or Firm*—Burd, Bartz & Gutenkauf

[57] ABSTRACT

An intensifier for delivering ultra high pressure water to a cutting head of a water jet cutting apparatus. The intensifier has a power piston and cylinder assembly connected to piston members extended into pumping chambers in housing located at opposite ends of the piston and cylinder assembly. Inlet poppet valves located in the pumping chambers control the flow of water from inlet passages into the pumping chambers. Outlet poppet valves allow ultra high pressure water to be pumped out of the pumping chamber into an accumulator fluidly connected to the cutting head. Hydraulic fluid under pressure is sequentially directed to opposite ends of the piston and cylinder assembly with a solenoid operated reversing valve. Limit switches operable in response to movement of the piston members control the reversing valve. Linear motion transfer mechanisms are moved with ramps on the piston members to actuate the limit switches to control the reciprocating action of the piston and cylinder assembly.

46 Claims, 4 Drawing Sheets

INTENSIFIER

FIELD OF INVENTION

The invention relates to reciprocating piston pumps for delivering a flow of ultra high pressure water. The pump is an intensifier for a waterjet cutting apparatus operable to generate ultra high water pressure for a cutting head that dispenses a high velocity water jet for cutting a workpiece.

BACKGROUND OF INVENTION

Water jet cutting machines have cutting heads equipped with nozzles that direct high pressure and high velocity jets of water to cut and drill workpieces. Intensifiers are used to increase the pressure of water to an ultra high pressure range of 60,000 to 100,000 psi or more. An example of a high pressure intensifier for producing a high velocity fluid jet stream is shown in U.S. Pat. No. 3,811,795. The ultra high pressure water is delivered to the cutting heads and discharged through nozzles as water jets which cut workpieces. Abrasive materials are introduced into the water flowing through the cutting heads in some waterjet cutting machines to increase the cutting action of the water jets. Examples of waterjet cutting machines are disclosed in U.S. Pat. Nos. 3,997,111 and 4,380,138.

SUMMARY OF INVENTION

The invention is directed to an improved intensifier for a water jet cutting machine that effectively and efficiently increases the pressure of water to an ultra high pressure range up to and greater than 60,000 psi. The intensifier has a power piston and cylinder assembly operable to reciprocate plungers or piston members in pumping chambers to generate ultra high pressure water. Inlet poppet valves located within the pumping chambers control the flow of water from inlet passages into the pumping chambers. Outlet poppet valves allow ultra high pressure water to flow from the pumping chambers into outlet passages leading to the cutting head and the nozzle for directing a high pressure water jet toward a workpiece. The piston and cylinder assembly has a cylinder with a chamber accommodating a piston. A solenoid operated valve selectively directs and vents hydraulic fluid under pressure to the chamber on opposite sides of the piston to reciprocate the piston and plungers connected thereto. Sleeves having ramps connect the piston to the plungers so that the plungers longitudinally move in the pumping chambers to generate ultra high pressure water. Switches connected to the solenoids energize the solenoids to operate the valve to control the flow of hydraulic fluid to and from the piston and cylinder assembly. Motion transfer structures operatively associate the switches with the ramps on the sleeves whereby the switches are sequentially actuated in response to movement of the ramps into engagement with the motion transfer structures thereby reverse the flow of hydraulic fluid to opposite ends of the cylinder to reciprocate the piston and plungers. The piston and plungers reciprocate at relatively high speeds to pump the water. It is essential to sense when it is time to reverse the piston direction before it impacts with the end heads. The motion transfer structures sense the positions of the ramps on the sleeves to prevent impact of the piston on the end heads while using as much of the available piston stroke as possible.

A preferred embodiment of the intensifier increases the pressure of water to the ultra high pressure range of 60,000 or more psi. The piston and cylinder assembly comprises a generally cylindrical casing or cylinder having a first end, a second end and an inside cylindrical wall surrounding an internal chamber. A piston is slideably located in the chamber for movement between the first and second ends of the casing. Fluid under pressure is selectively supplied and vented from opposite ends of the chamber to rapidly reciprocate the piston. A solenoid operated valve controls the flow of fluid to the chamber. The opposite ends of the cylinder are closed with heads having aligned passages for accommodating piston members or plungers connected to opposite sides of the piston. The opposite sides of the pistons have recesses that accomodate flanges of sleeves connected to the piston members. Rings secured to the piston engaged the flanges to retain the flanges in the recesses with limited radial clearance to allow for parallel misalignment when assembling the intensifier. The ends of the piston members extend into pumping chambers located in housings secured to the heads.

The heads have fluid inlet passages and inlet poppet valves for allowing water to flow through the inlet passages into the pumping chambers and preventing the reverse flow of water back into the fluid inlet passages. Outlet poppet valves allow the water to flow out of the pumping chambers and prevent the ultra high pressure water from flowing back into the pumping chambers. A control responsive to the reciprocating movements of the piston members actuates the valve means to reverse the flow of hydraulic fluid under pressure to the chamber on opposite sides of the piston whereby the piston and the piston members reciprocate to pump water into and out of the pumping chambers to deliver ultra high pressure flow of water to an accumulator and cutting head of a water jet cutting machine. The sleeves that connect the piston members to the opposite sides of the piston has ramp portions that are inclined away from the piston toward the longitudinal axis of the piston. The control includes electrical switches that are connected to the solenoids of the valve and linear motion transfer assemblies mounted on heads. Each motion transfer assembly has a finger engageable with a ramp portion to selectively actuate a switch when the piston is moved to positions adjacent the first and second heads thereby actuate the valve to reverse the flow of hydraulic fluid to the chamber thereby reciprocate the piston and piston members. The finger senses when it is time to reverse the piston direction and to prevent an impact or pounding of the piston on the heads without compromising the available piston stroke.

The inlet poppet valves are located within the pumping chambers to eliminate any conduits or lines that are pressure cycled thereby minimize fatigue failure of the poppet valve structure. The inlet poppet valves each have a body providing a pocket and at least one passage open to the pocket, the pumping chamber and the inlet passage. A valving member located in the pocket moves generally parallel to the longitudinal axis of the pumping chamber between open and closed positions to allow water to flow into the pumping chamber and block the flow of water back into the inlet passage. The valving member has a stem extended through a hole in the body to allow for rotational and linear movement of the valving member between its open and closed positions. Springs and other biasing structures are not used to maintain the valving member in closed position.

DESCRIPTION OF PREFERRED EMBODIMENT

Figure 1:
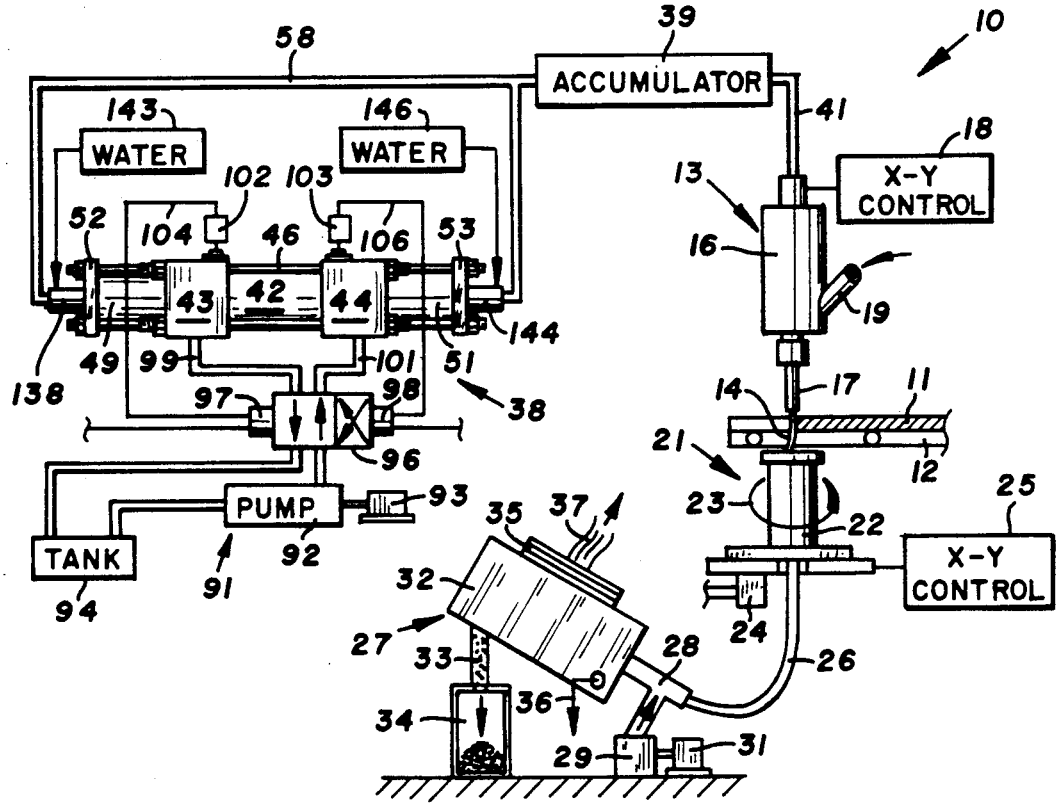
FIG. 1 is a diagrammatic view of an abrasive water jet cutting system equipped with the water pressure intensifier of the invention.

Referring to FIG. 1 there is shown a water jet cutting machine indicated generally at 10 for cutting a workpiece 11 located on a table 12. Machine 10 has a movable cutting head 13 that discharges an ultra high pressure water jet 14 having abrasive material or grit for cutting workpiece 11. An ultra high pressure water jet without an abrasive can be used to cut workpiece 11. Head 13 has a generally upright body 16 supporting a downwardly directed tubular member or nozzle 17. An X-Y control 18 is connected to body 16 to control the motion of head 13 in accordance with a computer and a program therefor (not shown). An example of cutter head 13 is shown and described in U.S. application Ser. No. 463,251 now U.S. Pat. No. 5,018,670, incorporated herein by reference.

The abrasive material is a grit which is delivered to body 16 through a tube 19 connected to an apparatus (not shown) for moving grit to body 16. An example of useable grit is a crushed pure almandine garnet marketed by Industrial Garnet Extractives, Inc. of West Paris, Ma. 04289. Other types of grit can be used as the abrasive material.

The water and grit of jet 14 along with the material cut from workpiece 11 is collected in a catcher, indicated generally at 21, located below table 12. Catcher 21 has a generally upright cylindrical housing 22 that is rotated as shown by arrow 23 with a motor 24. An example of catcher 21 is shown in U.S. Pat. No. 4,937,985, incorporated herein by reference. An X-Y control 25 connected to catcher 21 functions to move catcher 21 in accordance with the movement of cutting head 13 so that the entrance opening of catcher 21 is in a position to receive the water and grit of jet 14 along with the material cut from workpiece 11.

An elongated tube or hose 26 joined to the bottom of catcher 21 carries the water, grit and particles from workpiece 11 to an air, water, and solid separator indicated generally at 27. A venturi air pump 28 draws the materials through hose 26 and discharges the materials into separator 27. Pump 28 is supplied with air from a blower 29 connected to an electric motor 31. Separator 27 has a large tank 32 that accommodates a conveyor (not shown) used to carry the solid materials to the upper end of tank for discharge of solid materials 33 into a container 34, such as a drum. Water 36 is drained from the lower end of tank 32. An air filter 35 mounted on top of tank 32 allows clean air 37 to be discharged into the atmosphere.

Cutting head 13 is supplied with a water under ultra high pressure in the range of 60,000 to 100,000 or more psi with a intensifier indicated generally at 38. Intensifier 38 delivers a continuous supply of ultra high pressure water to an accumulator 39 connected to a line 41 leading to the top of body 16 of cutter head 13.

Figure 2:
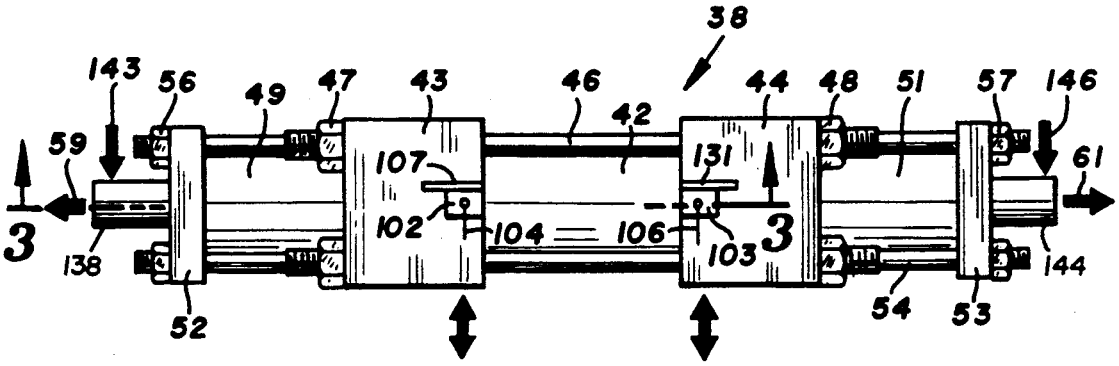
FIG. 2 is a top plan view of the water pressure intensifier shown in FIG. 1.

Referring to FIG. 2, intensifier 38 has a central power cylinder 42 comprising a piston and cylinder assembly closed at its opposite ends with heads 43 and 44. A plurality of rods 46 extend through holes in heads 43 and 44. Nuts 47 and 48 threaded onto opposite ends of rods 46 clamp heads 43 and 44 onto opposite ends of cylinder 42. A first high pressure pump cylinder 49 is located adjacent the outer end of head 43. A similar second high pressure pump cylinder 51 is located adjacent the outside of head 44. The outer ends of cylinders 49 and 51 are closed with blocks or housings 52 and 53. A plurality of rods 54 accommodating nuts 56 and 57 clamp blocks 52 and 53 onto the outer ends of the high pressure pump cylinders 49 and 51.

Intensifier 38 is a high speed reciprocating pump operable to receive water at relatively low pressure and discharge ultra high pressure water via lines or pipes 58 to accummulator 39, indicated by arrows 59 and 61 in FIG. 2.

Figure 3:
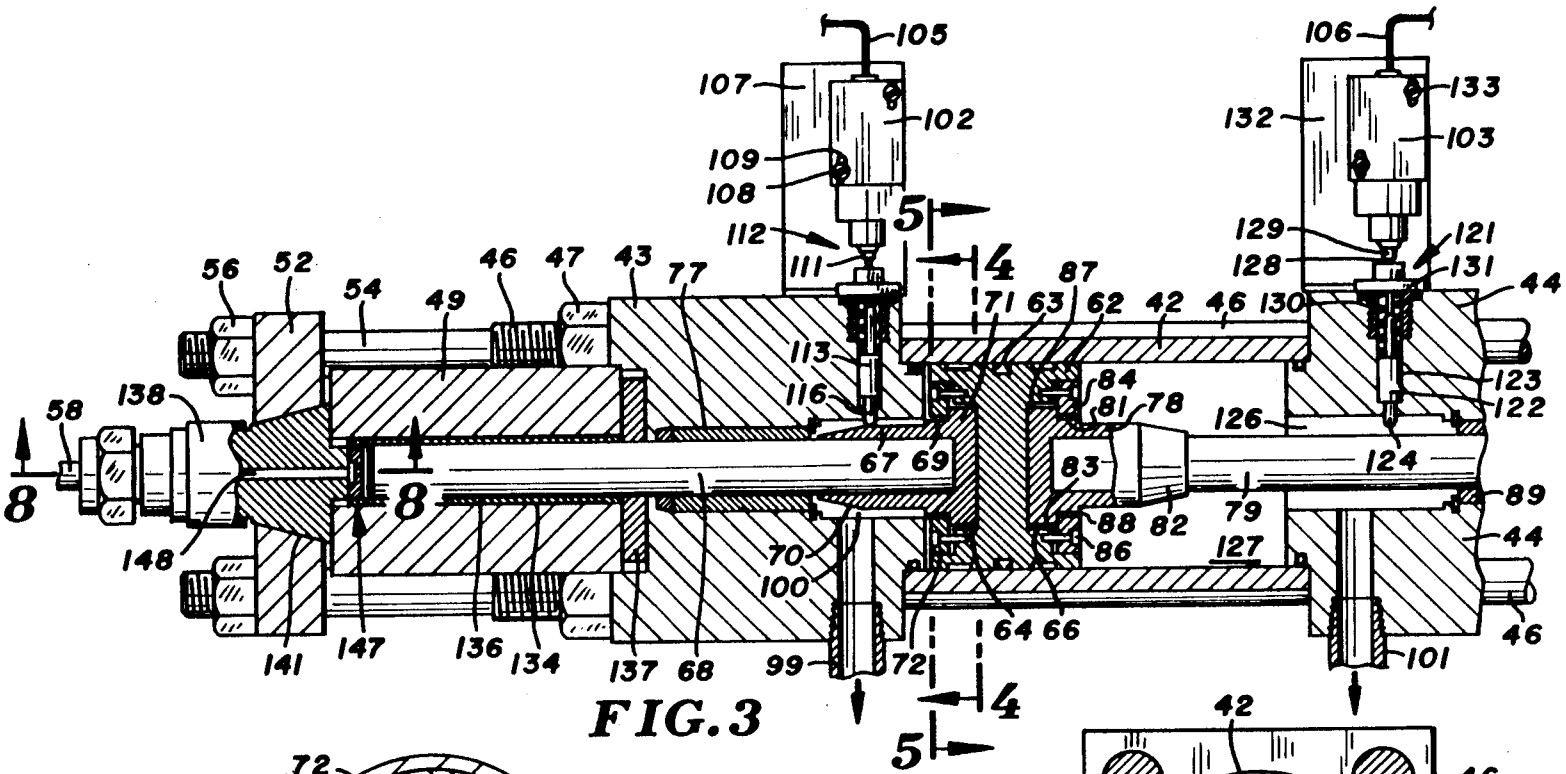
FIG. 3 is an enlarged sectional view taken along line 3—3 of FIG. 2.
Figure 4:
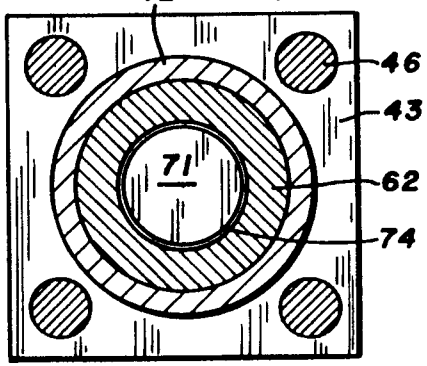
FIG. 4 is an enlarged sectional view taken along the line 4—4 of FIG. 3.
Figure 5:
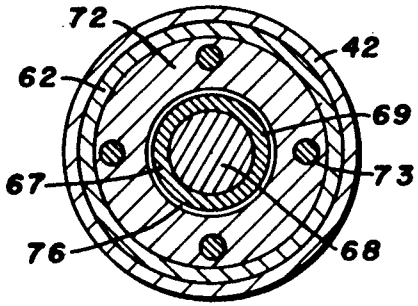
FIG. 5 is an enlarged sectional view taken along line 5—5 of FIG. 3.

Referring to FIG. 3, a piston 62 located within power cylinder 42 supports an annular peripheral seal 63 that slides on the inside surface of cylinder 42. The opposite sides of piston 62 have stepped recesses 64 and 66 that accommodate pistons or high pressure pumping plungers or piston members 68 and 79. Piston member 68 has an end located within a sleeve 67. Sleeve 67 has a longitudinal bore accommodating the end of piston member 68 with a press fit. The end of piston member is smooth. It does not have splines, grooves or holes that can cause stress risers in the piston member. Sleeve 67 has a circular shoulder 69 and a cone shaped nose or ramp 70. An outwardly directed annular flange 71 is joined to shoulder 69. A ring 72 threaded into piston 62 engages flange 71 to retain sleeve 67 in clearance assembled relation with piston 62. A plurality of cap screws 73 secure ring 72 to piston 62 to prevent rotation of ring 72 relative to piston 62. As shown in FIG. 4, flange 71 has an outer peripheral or circumferential surface a diameter that is smaller than the internal diameter of recess 64 thereby providing an annular space or clearance 74 between piston 62 and the outer peripheral surface of flange 71. As seen in FIG. 5, shoulder 69 of sleeve 67 has an outer peripheral surface that is spaced inwardly from the inner surface of annular member or ring 72 thereby providing an annular space or clearance 76. The clearance spaces 74 and 76 allow limited transverse or lateral movement of piston 62 relative to sleeve 67 to accommodate for parallel misalignments and manufacturing tolerances to insure linear reciprocal movement of piston member 68 within tubular bearing 77 located in head 43 and eliminate binding, twisting, and bending of parts.

The opposite side of piston 62 accommodates a sleeve 78 attached to piston member 79. Sleeve 78 has an annular shoulder 81 and a cone nose 84. An outwardly directed annular flange 83 is located adjacent shoulder 81. A ring or annular member 82 threaded into piston 62 engages flange 83 and retains sleeve 78 in assembled relation with piston 62. A plurality of cap screws 86 prevent rotation of ring 84 relative to piston 62. Flange 83 has radial clearance or space 87 with respect to piston 62. Shoulder 81 has radial space or annular clearance 88 with respect to ring 84. The clearance spaces 87 and 88 allow sleeve 78 and piston 62 to have relative lateral or radial movement relative to each other to eliminate parallel misalignment and lateral binding, twisting or bending of the parts. Piston member 79 extends from sleeve 78 into a tubular bearing 89 in head 44.

Returning to FIG. 1, a hydraulic fluid pressure system indicated generally at 91 operates to sequentially supply hydraulic fluid, such as oil under pressure, to opposite sides of cylinder 42 to reciprocate piston 62. Hydraulic fluid pressure system 91 has a pump 92 driven with a motor 93, such as an electric motor. The hydraulic fluid is drawn from tank 94 and delivered under pressure to a reversing solenoid operated valve 96. Valve 96 has a movable spool connected at its opposite ends to solenoids 97 and 98. A first line or pipe 99 connects valve 96 to head 43 to deliver hydraulic fluid under pressure to a passage 100 leading to one end of cylinder chamber 127. A second line 101 connects valve 96 to head 44 to deliver hydraulic fluid under pressure to passage 126 leading to the opposite end of chamber 127. Solenoid 97 is controlled with a limit switch 102 mounted on top of head 43. An electrical conductor 104 connects solenoid 97 with limit switch 102. A second limit switch 103 mounted on head 44 is connected with a electrical conductor 106 to solenoid 98. Limit switches 102 and 103 function to selectively energize solenoids 97 and 98 cause reverse flow of hydraulic fluid under pressure to opposite sides of piston 62 thereby reciprocate piston 62 in power cylinder 42.

Figure 6:
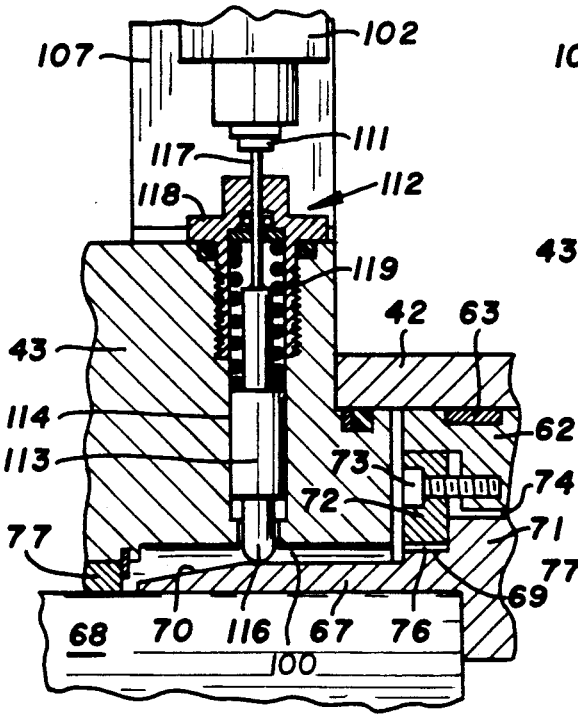
FIG. 6 is an enlarged sectional view of one motion transfer assembly and switch of the intensifier of FIG. 3 in the on position.
Figure 7:
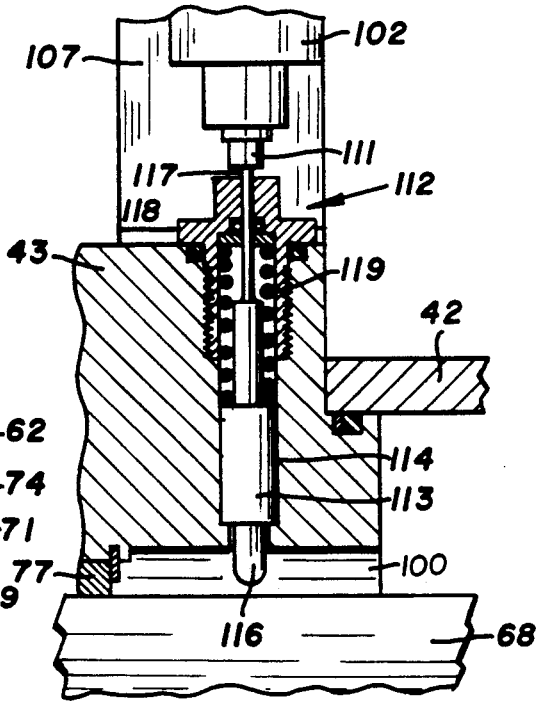
FIG. 7 is a sectional view of the motion transfer assembly and switch similar to FIG. 6 in the off position.

As shown in FIG. 3, an upright bracket 107 mounted on top of head 43 supports limit switch 102 in a generally upright position. A plurality of screws 108 secure switch 102 to a side of bracket 107. Limit switch 102 has elongated upright holes 109 which allow for vertical adjustment of limit switch 102 on bracket 107. Limit switch 102 has a downwardly directed actuator 111 located in operative relationship relative to a linear motion transfer assembly indicated generally at 112 in FIGS. 6 and 7. Assembly 112 has a cylindrical body 113 reciprocally located in a radial bore 114 in head 43. A downwardly directed finger 116 joined to body 113 extends into passage 100 in the traveling path of sleeve 67. The upper end of body 113 is joined to an upright rod 117 that extends through a cap 118 and engages actuator 111. Cap 118 is threaded into bore 114 to secure the linear motion transverse assembly 112 to head 43. A coil spring 119 surrounding rod 117 biases body 113 and finger 116 in an inward direction as shown in FIG. 7. Returning to FIG. 6, when ramp 70 engages finger 116 body 113 moves up in bore 114 so that rod 117 actuates limit switch 102 thereby reversing valve 96 terminating the supply of hydraulic fluid through passage 126 to chamber 127 and providing hydraulic fluid to passage 100. This reverses movement of piston 62 in cylinder 42.

A linear motion transfer assembly 121 having the same structure as motion transfer assembly 112 is associated with limit switch 103 mounted on head 44. As seen in FIG. 3, linear motion transfer assembly 121 has an upright cylindrical body 122 slidably located in a radial bore 123 in head 44. A downwardly direct finger 124 joined to body 122 extends into passage 126 open to cylinder chamber 127. An upright rod 128 joined to body 122 engages actuator 129 of limit switch 103. A cap 131 threaded into head 44 retains the linear motion transfer assembly 121 on head 44. A coil spring 130 engagable with cap 131 and body 122 biases finger 124 inwardly into passage 126. An upright bracket 132 secured to head 44 supports limit switch 103 in a vertical position. A plurality of screws 133 extended through upright slots secure limit switch 103 to a side of bracket 132. The upright slots allow limit switch 103 to be vertically adjusted thereby changing the time in which limit switch 103 would be actuated in response to movement of finger 124 on engagement with cone shaped nose 82 of sleeve 78.

As shown in FIG. 3, when piston 62 is moved to the left in response to application of fluid under pressure through line 101 and passage 126 to chamber 127, sleeve 67 will move into passage 100. The cone shaped nose 70 of sleeve 67 engages the bottom of finger 116 thereby moving body 113 and rod 117 in an upward direction thereby actuating limit switch 102. This causes valve 96 to reverse in response to the energization of solenoid 97. The flow of fluid under pressure through passage 126 to chamber 127 is terminated with the fluid under pressure being supplied to passage 100 prior to the time that piston 62 and ring 72 engage the end of head 43. This prevents the pounding and impact contact of piston 62 with head 43. The timing of the reversing of valve 96 can be adjusted by vertically adjusting the position of limit switch 102 on bracket 107. This adjusts the stroke of piston 62. On application of fluid under pressure to passage 100 piston 62 will move to the right. The fluid in chamber 127 flows through passage 126 and line 101 through valve 96 back to tank 94. When piston 62 approaches head 44 the cone shaped nose 82 of sleeve 78 will engage finger 124 thereby actuate limit switch 103. This causes valve 96 to reverse as solenoid 98 is energized thereby reversing the flow of hydraulic fluid under pressure to chamber 127 on opposite sides of piston 62. Piston 62 continuously reciprocates as long as the pump 92 supplies hydraulic fluid under pressure to valve 96.

Figure 8:
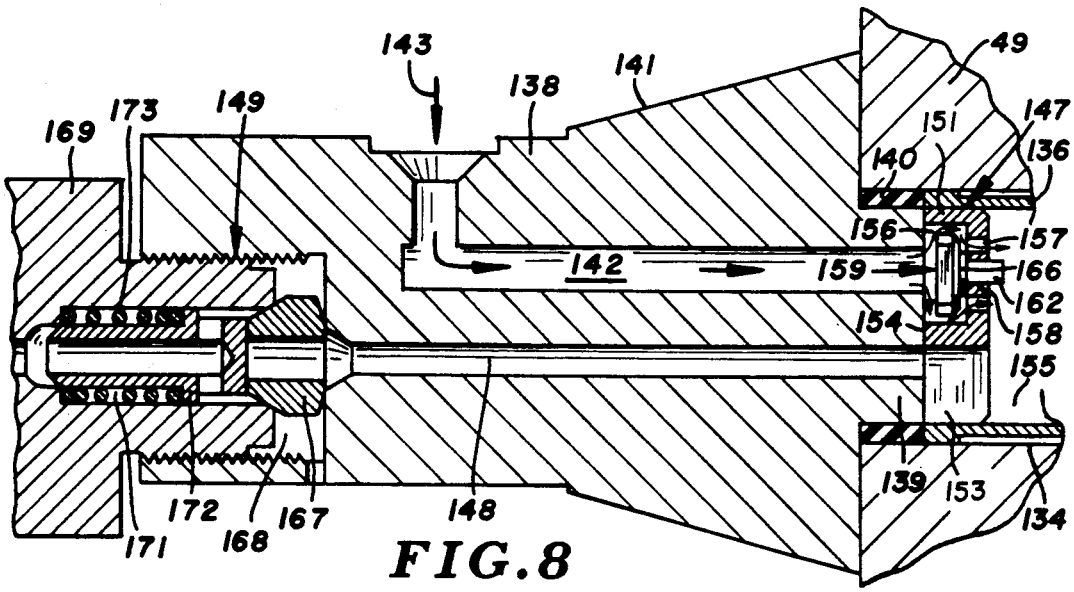
FIG. 8 is an enlarged sectional view taken along the line 8—8 of FIG. 3 showing the water inlet poppet valve in the open position.
Figure 9:
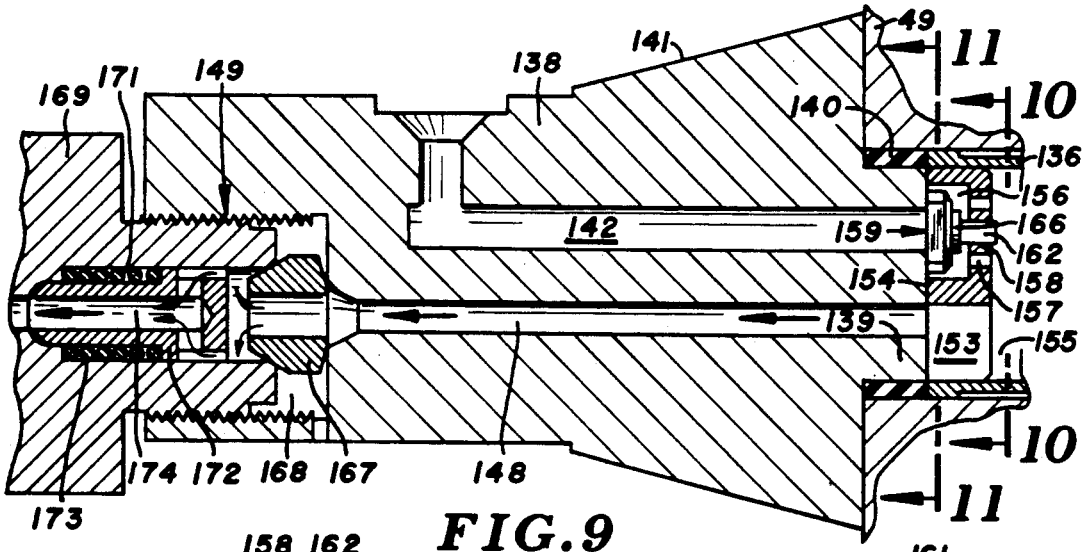
FIG. 9 is a sectional view similar to FIG. 8 showing the water inlet poppet valve in the closed position.
Figure 10:
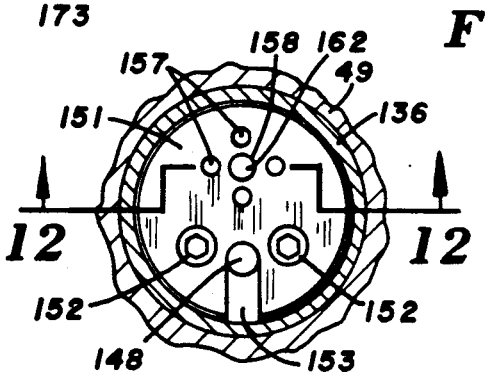
FIG. 10 is an enlarged sectional view taken along line 10—10 of FIG. 9.

Returning to FIG. 3, high pressure pump cylinder 49 has a central axial bore 134 accommodating a sleeve or tube 136 having an internal cylindrical surface located in sliding sealing engagement with the outside peripheral surface of piston member 68. A plate 137 interposed between cylinder 49 and head 43 retains sleeve 136 in assembled relation with cylinder 49 and ensures the seals at opposite ends of sleeve 136 are retained in place. A high pressure housing 138 is located in engagement with the outer end of cylinder 49. As shown in FIGS. 8 and 9, housing 138 has a cylindrical boss 139 that extends into bore 134. An annular seal 140 surrounds boss 139. Housing 138 has an external cone face 141 that fits into a tapered hole in plate 52 whereby plate 52 retains housing 138 in tight sealing relation with cylinder 49.

Housing 138 has a water inlet passage 142 connected to a water supply 143. Passage 142 leads through boss 139 to a low pressure inlet poppet valve assembly indicated generally at 147. Inlet poppet valve assembly 147 is located within pump chamber 155 to reduce fatigue failures of the body 151 of the valve assembly. The opposite end of intensifier 38 has a second high pressure housing 144 secured with plate 53 to the end of cylinder 51. Housing 144 is connected to a water supply 147. The internal components of housing 144 are identical to the housing 138 including the lower pressure inlet poppet valve assembly 146 and the high pressure outlet poppet valve 149 as shown in FIGS. 8 and 9. Housing 138 has a linear outlet passage 148 generally parallel to the inlet passage 142 leading from pump chamber 155 to the high pressure outlet poppet valve assembly 149.

Figure 12:
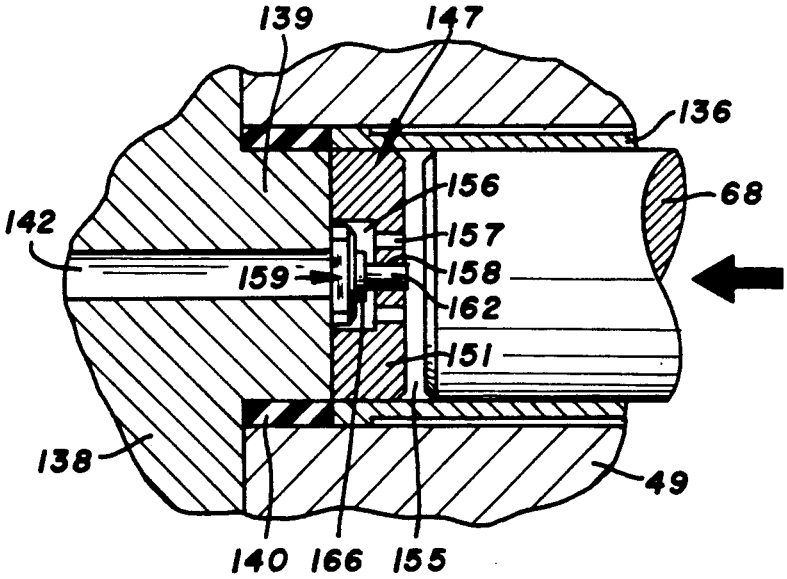
FIG. 12 is an enlarged sectional view taken along line 12—12 of FIG. 10.
Figure 11:
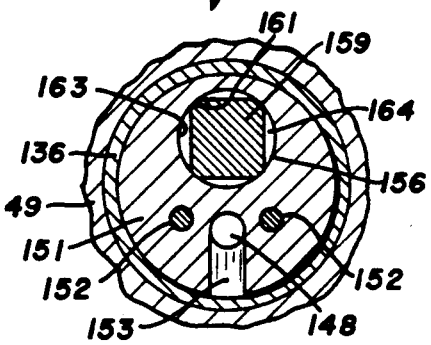
FIG. 11 is an enlarged sectional view taken along line 11—11 of FIG. 9.

As shown in FIGS. 8 to 12, low pressure inlet poppet valve assembly 147 has a cylindrical housing or body 151 located in engagement with the end of boss 139 at the end of pumping chamber 155. Valve assembly 147 has a low profile and closes the end of pumping chamber 155, as shown in FIG. 12. A plurality of cap screws 152 secure body 151 to boss 139. Body 151 has a downwardly directed slot 153 in registration with water outlet passage 148 of housing 138 to allow for free flow of water from high pressure pumping chamber 155 to outlet passage 149 leading to high pressure outlet poppet valve assembly 148. The face 154 of body 151 is flat and in surface engagement with the outer flat face of boss 139. Body 151 has a circular recess or pocket 156 open to face 154. A plurality of holes 157 surrounding a center hole 158 are open to pocket 156 and pumping chamber 155. A floating valving member indicated generally at 159 located in pocket 156 moves generally parallel to the longitudinal axis of the pumping chamber 155 between an open position as shown in FIG. 8 and a closed position as shown in FIG. 9 without the use of a biasing spring. Valving member 159 has a generally square shape with curved corners or outer arcuate edges 161 and an axial stem 162 extended through central hole 158. The outer arcuate edges 161 and stem 162 guide and control the linear open and closing movements of valving member 159 and allow rotation of valving member 159 about its axis of movement. As shown in FIG. 11, inner wall 163 in body 151 which defines pocket 156 is larger than valving member 159 thereby providing spaces or areas 164 around valving member 159. The cross sectional area of spaces 164 is smaller than the combined cross sectional areas of holes 157 in body 151. Also, the combined cross sectional area of holes 157 is smaller than the cross sectional area of water inlet passage 142 to provide a pressure drop across valving member 159 during the pumping of water from pump chamber 155. When piston member 68 moves away from low pressure inlet poppet valve assembly 147, valving member 159 will move to an open position wherein shoulder 166 surrounding stem 162 will engage body 151 to provide a flow passage around valving member 159 as seen in FIG. 8. This allows the water to flow into pump chamber 155. When piston member 68 is moved in the opposite direction toward low pressure inlet poppet valve assembly 147, valving member 159 will quickly close since spaces 164 restrict reverse flow or water into passage 142. The restricted flow is due to the smaller cross sectional area of spaces 164 relative to the total cross sectional areas of holes 157 and the smaller total cross sectional areas of holes 157 relative to the cross sectional area of passage 142. As shown in FIG. 9, when valving member 159 is in the closed position the flat face of valving member 159 is in surface engagement with an annular seat or surface of boss 139 surrounding inlet opening 142. Valving member 159 has a relatively short travel distance between its open and closed positions and a fast valving time cycle.

High pressure outlet poppet valve assembly 149 has a seat 167 comprising an annular member located adjacent the outer end of the water outlet passage 148. Seat 167 is located in a threaded bore 168 in the outer end of high pressure housing 138. A connector 169 threaded into bore 168 holds seat 167 in fixed relationship relative to housing 138. Connector 169 has a passage 171 accommodating a moveable check valve 172. A spring 173 biases check valve 172 into closed relationship relative to seat 167 as seen in FIG. 8. When the pressure in pumping chamber 155 is sufficient to overcome the force of spring 173 and the high pressure of the water in line 58, check valve 172 will move to the open position to allow high pressure water to flow through passage 148, check valve passage 174 and into line 58. The high pressure housing 144 at the opposite end of the intensifier has an identical check valve for controlling the flow of water into line 58 leading to the accumulator 39.

In use, pump 92 is operable to supply hydraulic fluid under pressure selectively to opposite ends of chamber 127 of cylinder 42 thereby reciprocate piston 62. Piston 62 being connected to the piston members 68 and 79 causes the reciprocating pumping of the piston members 68 and 79 in high pressure cylinders 49 and 51. The limit switches 102 and 103 selectively reverse valve 96 to prevent piston 62 from hitting and pounding on heads 43 and 44 during the reciprocal movement of piston 62 in cylinder 42. The linear motion transfer assemblies 112 and 121 mounted on heads 43 and 44 are normally disposed relative to the travel of piston members 68 and 79. Limit switches 102 and 103 are sequentially actuated by movement of inclined cone noses or ramps 70 and 82 of sleeves 67 and 78 into engagement with fingers 116 and 124. Limit switches 102 and 103 are vertically adjustable on their supporting brackets 107 and 132 respectively to change the time at which the limit switches 102 and 103 are actuated thereby change the stroke of piston 62 in cylinder 42. Limit switches 102 and 103 are adjusted so that the piston 62 and rings 72 and 84 secured to piston 62 do not hit or pound on heads 43 and 44 during the reciprocal movement of piston 62. The motion transfer assemblies 112 and 121 being normally disposed with respect to the movement of piston members 68 and 79 allow for close and compact structural arrangement between piston members 68 and 79 and cylinders 49 and 51. The lateral locations of the limit switches 102 and 103 do not interfere or compromise the stroke or travel of piston members 68 and 79 relative to the pumping chambers.

During the intake stroke of piston member 68, the inlet poppet valving member 159 moves to the open position whereby water under relatively low pressure flows through inlet passage 142 around valving member 159 and through holes 157 into pumping chamber 155. The open position of valving member 159 is shown in FIG. 8. When the direction of movement of piston member 68 is reversed, piston member 68 moves toward valving member 159 whereby the pressure of the water in pumping chamber 155 substantially increases to the ultra high pressure range causing valving member 159 to quickly close. The difference in the pressure between the pumping chamber 155 and inlet passage 142 maintains the valving member 159 closed. The high pressure water flows through the outlet passage 148 through check valve 172 and into pipe 58 leading to accumulator 39. The ultra high pressure water flows through pipe 41 to head 13. The water is discharged at a high velocity and high pressure as a jet 14 which cuts the workpiece. The grit incorporated into the jet facilitates the cutting operation. The water from the jet, grit, and material from the workpiece is collected with the catcher 21 and delivered to liquid solid separator 27 which separates air, solids, and water.

While there has been shown and described a preferred embodiment of the intensifier for the water jet cutting machine of the invention it is understood that changes in the structure, arrangement of structure, materials, and fluids and grits may be made by those skilled in the art without departing from the invention. The invention is defined in the following claims.

We claim:

1. An apparatus for increasing the pressure of hydraulic fluid and to deliver an ultra high pressure flow of hydraulic fluid comprising: casing means having a first end, a second end, and an inside wall surrounding an internal chamber; piston means located in said chamber in sliding relation with said inside wall, means for selectively supplying and venting hydraulic fluid under pressure to said chamber on opposite sides of the piston means to reciprocate the piston means in said chamber between said first and second ends, said means having valve means controlled with solenoid means for reversing the flow of hydraulic fluid to said chamber on opposite sides of the piston means, a first head closing the first end of the casing means having a first passage open to said chamber, a second head closing the second end of the casing means having a second passage open to said chamber, a first piston member connected to the piston means and extended through the first passage, a second piston member connected to the piston means and extended through the second passage, a first sleeve means connecting the piston means with the first piston member, a second sleeve means connecting the piston means with the second piston member, each sleeve means having a ramp portion inclined toward the longitudinal axis of the adjacent piston member, a first housing having a first pumping chamber mounted on the first head having a longitudinal axis parallel to the longitudinal axis of the first piston member, said first piston member extended into the first pumping chamber, first inlet valve means for allowing hydraulic fluid to flow from a first fluid inlet passage into the first pumping chamber and preventing hydraulic fluid to flow out of the first pumping chamber back into the first fluid inlet passage, a first outlet valve means for allowing hydraulic fluid to flow out of the first pumping chamber and preventing high pressure hydraulic fluid to flow back into the first pumping chamber, a second housing having a second pumping chamber mounted on the second head having a longitudinal axis parallel to the longitudinal axis of the second piston member, said second piston member extended into the second pumping chamber, second inlet valve means for allowing hydraulic fluid to flow from the second fluid inlet passage into the second pumping chamber, a second outlet valve means for allowing hydraulic fluid to flow out of the second pumping chamber and preventing high pressure hydraulic fluid to flow back into the second pumping chamber and control means responsive to reciprocating movements of the first and second piston members to actuate the solenoid means to reverse the flow of hydraulic fluid under pressure to the chamber on opposite sides of the piston means whereby the piston means reciprocates the piston members to pump hydraulic fluid into and out of the first and second pumping chambers to deliver an ultra high pressure flow of hydraulic fluid, said control means including switch means connected to the solenoid means of the valve means, and linear motion transfer means mounted on each head, each linear motion transfer means having a finger engagable with said ramp portion to selectively actuate the switch means when the piston means is moved to positions adjacent the valve means to reverse the flow of hydraulic fluid to the chamber on opposite sides of the piston means.

2. The apparatus of claim 1 wherein: each motion transfer means comprises a body located in the bore in a head, said finger being secured to the body, a rod attached to the body engagable with the switch means operable to actuate the switch means when the finger engages the ramp portion of the sleeve means, biasing means engagable with the body for biasing the finger toward the adjacent sleeve means, and cap means mounted on the head to retain the body and biasing means in assembled relation with the head.

3. The apparatus of claim 1 including: bracket means mounted on the heads, and means connecting the switch means to the bracket means in alignment with the linear motion transfer means, said latter means being adjustable whereby the position of the switch means relative to the linear motor transfer means can be adjusted to alter the actuation time of the switch means to change the stroke of the piston means.

4. The apparatus of claim 1 wherein: the piston means has recess means on opposite sides thereof, said first and second sleeve means each having an annular flange located in one of the recess means, means secured to the piston means to retain the flange in said recess means, said flange being smaller than the recess means whereby said piston members have limited lateral movement relative to the piston means.

5. The apparatus of claim 4 wherein: the means secured to the piston means comprises an annular ring engagable with the flange to hold the flange in the recess means.

6. The apparatus of claim 1 wherein: the first and second inlet valves each have a body having a pocket and at least one passage open to the pocket, the pumping chamber, and the inlet passage, an annular seat surrounding the inlet passage open to the pocket, a valving member located in said pocket movable in response to flow of hydraulic fluid generally parallel to the longitudinal axis of the pumping chamber between open and closed positions to allow hydraulic fluid to flow into the pumping chamber and block the flow of hydraulic fluid back into the inlet passage, said valving member having a surface engagable with the annular seat to close the inlet passage.

7. The apparatus of claim 6 wherein: said body has a hole open to the center of the pocket, said valving member includes a stem extended through said hole to guide said valving member for movement in said pocket between open and closed positions of the valving member.

8. An apparatus for increasing the pressure of hydraulic fluid and to deliver an ultra high pressure flow of hydraulic fluid comprising: casing means having a first end, a second end, and an inside wall surrounding an internal chamber, piston means located in said chamber in sliding relation with said inside wall, means for selectively supplying and venting hydraulic fluid under pressure to said chamber on opposite sides of the piston means to reciprocate the piston means in said chamber between said first and second ends, said means having valve means controlled with solenoid means for reversing the flow of hydraulic fluid to said chamber on opposite sides of the piston means, a first head closing the first end of the casing means having a first passage open to said chamber, a second head closing the second end of the casing means having a second passage open to said chamber, a first piston member connected to the piston means and extended through the first passage, a second piston member connected to the piston means and extended through the second passage, a first housing having a first pumping chamber mounted on the first head having a longitudinal axis parallel to the longitudinal axis of the first piston member, said first piston member extended into the first pumping chamber, first inlet valve means for allowing hydraulic fluid to flow from a first fluid inlet passage into the first pumping chamber and preventing hydraulic fluid to flow out of the first pumping chamber back into the first fluid inlet passage, a first outlet valve means for allowing hydraulic fluid to flow out of the first pumping chamber and preventing high pressure hydraulic fluid to flow back into the first pumping chamber, a second housing having a second pumping chamber mounted on the second head having a longitudinal axis parallel to the longitudinal axis of the second piston member, said second piston member extended into the second pumping chamber, second inlet valve means for allowing hydraulic fluid to flow from the second fluid inlet passage into the second pumping chamber, a second outlet valve means for allowing hydraulic fluid to flow out of the second pumping chamber and preventing high pressure hydraulic fluid to flow back into the second pumping chamber, the first and second inlet valves each have a body having a pocket and at least one passage open to the pocket, the pumping chamber, and the inlet passage, an annular seal surrounding the inlet passage open to the pocket, a valving member located in said pocket movable in response to the flow of hydraulic fluid generally parallel to the longitudinal axis of the pumping chamber between open and closed positions to allow hydraulic fluid to flow into the pumping chamber and block the flow of hydraulic fluid back into the inlet passage, said valving member having a surface engagable with the annular seat to close the inlet passage, said body having a hole open to the center of the pocket, said valving member includes a stem extended through said hole to guide said valving member for movement in said pocket between open and closed positions of the valving member, said valving member having arcuate corner portions located adjacent a cylindrical wall in said body surrounding said pocket, said corner portions cooperating with said cylindrical wall and said stem cooperating with a wall forming the hole to guide said valving member for movement between open and closed positions of the valving member and control means responsive to reciprocating movements of the first and second piston member to actuate the valve means to reverse the flow of hydraulic fluid under pressure to the chamber on opposite sides of the piston means whereby the piston means reciprocates the piston members to pump hydraulic fluid into and out of the first and second pumping chambers to deliver an ultra high pressure flow of hydraulic fluid.

9. The apparatus of claim 8 wherein: said passage in the body has a cross sectional area smaller than the cross sectional area of the inlet passage.

10. An apparatus for increasing the pressure of hydraulic fluid and to deliver ultra high pressure flow of output hydraulic fluid comprising: a piston and cylinder assembly having a cylinder with an internal chamber and a piston located in said chamber for reciprocating movement therein, means for selectively supplying fluid under pressure and venting fluid from the chamber on opposite sides of the piston to reciprocate said piston in said chamber, head means mounted on said piston and cylinder assembly having a passage open to said chamber, a piston member connected to the piston and extended through said passage, sleeve means connecting the piston with the piston member, said sleeve means having a ramp portion inclined towards the axis of the piston member, a housing having a pumping chamber mounted on said head means with said pumping chamber aligned with said passage, said piston member having a forward end located within said pumping chamber, hydraulic fluid inlet valve means for allowing hydraulic fluid to flow into the pumping chamber and preventing hydraulic fluid to flow out of the pumping chamber into a fluid inlet passage, hydraulic fluid outlet valve means for allowing hydraulic fluid to flow back into the pumping chamber, and control means responsive to reciprocating movement of the piston member to reverse the flow of fluid under pressure to the chamber on opposite sides of the piston whereby the piston reciprocates the piston member to pump hydraulic fluid into and out of the pumping chamber, said control means including reversing means to change the direction of the flow of fluid under pressure to the chamber on opposite sides of said piston, and means engageable with the ramp portion of the sleeve means to control the reversing means for supplying hydraulic fluid under pressure to the chamber on opposite sides of the piston when the piston is moved to a position adjacent the head means thereby reversing the flow of hydraulic fluid to the chamber on opposite sides of the piston.

11. The apparatus of claim 10 wherein: said means engageable with the ramp portion is motion transfer means having a finger adapted to be engaged by the ramp portion to actuate the reversing means to change the direction of the flow of hydraulic fluid under pressure to the chamber on opposite sides of the piston, said motion transfer means comprising a body located in a bore in the head means, said finger being secured to the body, a rod attached to the body and movable with said body to actuate the reversing means for changing the direction of the flow of fluid under pressure to the chamber on opposite sides of the piston, biasing means engageable with the body for biasing the finger toward the adjacent sleeve means, and cap means mounted on the head means to retain the body and biasing means in assembled relation with the head means.

12. The apparatus of claim 11 including: bracket means mounted on the head means, means connecting the reversing means to the bracket means in alignment with the motion transfer means, said latter means being adjustable whereby the position of the reversing means relative to the motion transfer means can be adjusted to alter the actuation time of the reversing means.

13. The apparatus of claim 10 wherein: the piston has a recess, and sleeve means connecting the piston to the piston member, said sleeve means having an annular flange located in said recess, means secured to the piston to retain the annular flange in said recess, said annular flange being smaller than the recess whereby said piston member has limited lateral movement relative to the piston.

14. The apparatus of claim 13 wherein: the means secured to the piston comprises an annular ring engagable with the annular flange to hold the annular flange in the recess.

15. The apparatus of claim 10 wherein: the inlet valve means has a body with a pocket, and at least one passage open to the pocket, the pumping chamber, and the inlet passage, the inlet passage being surrounded by an annular seat, a valving member located in said pocket moveable generally parallel to the longitudinal axis of the pumping chamber between open and closed positions to allow hydraulic fluid to flow into the pumping chamber and block the flow of hydraulic fluid back into the inlet passage, said valving member having a surface engageable with the seat to close said inlet passage.

16. The apparatus of claim 15 wherein: said body has a hole open to the center of the pocket, said valving member includes a stem extended through said hole to guide said valving member for movement in said pocket.

17. An apparatus for increasing the pressure of hydraulic fluid and to deliver ultra high pressure flow of output hydraulic fluid comprising: a piston and cylinder assembly having a cylinder with an internal chamber and a piston located in said chamber for reciprocating movement therein, means for selectively supplying fluid under pressure and venting fluid from the chamber on opposite sides of the piston to reciprocate said piston in said chamber, head means mounted on said piston and cylinder assembly having a passage open to said chamber, a piston member connected to the piston and extended through said passage, a housing having a pumping chamber mounted on said head means with said pumping chamber aligned with said passage, said piston member having a forward end located within said pumping chamber, hydraulic fluid inlet valve means for allowing hydraulic fluid to flow into the pumping chamber and preventing hydraulic fluid to flow out of the pumping chamber into a fluid inlet passage, hydraulic fluid outlet valve means for allowing hydraulic fluid to flow out of the pumping chamber into a fluid outlet passage, the inlet valve means having a body with a pocket, and at least one passage open to the pocket, the pumping chamber, and the inlet passage, the inlet passage being surrounded by an annular seat, a valving member located in said pocket moveable generally parallel to the longitudinal axis of the pumping chamber between open and closed positions to allow hydraulic fluid to flow into the pumping chamber and block the flow of hydraulic fluid back into the inlet passage, said valving member having a surface engageable with the seat to close said inlet passage, said body having a hole open to the center of the pocket, said valving member includes a stem extended through said hole to guide said valving member for movement in said pocket, said valving member having arcuate corner portions located adjacent a cylindrical wall in said body surrounding said pocket, said corner portions cooperating with said cylindrical wall and said stem cooperating with a wall forming the hole to guide said valving member for movement between open and closed positions of the valving member, and control means responsive to reciprocating movement of the piston member to reverse the flow of fluid under pressure to the chamber on opposite sides of the piston whereby the piston reciprocates the piston member to pump hydraulic fluid into and out of the pumping chamber.

18. The apparatus of claim 17 wherein: said one passage has a cross sectional area smaller than the cross sectional area of the inlet passage.

19. An apparatus for increasing the pressure of hydraulic fluid and to deliver ultra high pressure flow of hydraulic fluid comprising: first means having an internal chamber, second means movably located in said chamber for reciprocating movement within the internal chamber, third means for selectively causing said second means to reciprocate in said chamber, said third means including fourth means controlled with solenoid means for reversing the movement of the second means, a first head mounted on the first means having a first passage open to said chamber, a second head mounted on the first means having a second passage open to said chamber, a first piston member connected to the second means and extended through the first passage, a first sleeve means connecting the second means with the first piston member, a second piston member connected to the second means and extended through the second passage, a second sleeve connecting the second means with the second piston member, each sleeve means having a ramp portion inclined toward the longitudinal axis of the adjacent piston member, a first housing having a first pumping chamber mounted on the first head having a longitudinal axis parallel to the longitudinal axis of the first piston member, said first piston member extended into the first pumping chamber, first inlet valve means for allowing hydraulic fluid to flow from a first fluid inlet passage into the first pumping chamber and preventing hydraulic fluid to flow out of the first pumping chamber back into the fluid inlet passage, a first outlet valve means for allowing hydraulic fluid to flow out of the pumping chamber and preventing high pressure hydraulic fluid to flow back into the first pumping chamber, a second housing having a second pumping chamber mounted on the second head having a longitudinal axis parallel to the longitudinal axis of the second piston member, said second piston member extended into the second pumping chamber, second inlet valve means for allowing hydraulic fluid to flow from a second fluid inlet passage into the second pumping chamber, and control means responsive to reciprocating movements of the first and second piston members to actuate the fourth means to reverse the movement of the second means whereby the second means reciprocates the piston members to pump hydraulic fluid into and out of the first and second pumping chambers to deliver an ultra high pressure flow of hydraulic fluid, said control means including switch means connected to the solenoid means of the fourth means, and linear motion transfer means having a finger engageable with said ramp portion to selectively actuate the switch means when the second means is moved to position adjacent the first and second heads thereby actuate the fourth means to reverse the movement of the second means.

20. The apparatus of claim 19 wherein: each motion transfer means comprises the body located in a bore in a head, said finger being secured to the body, a rod attached to the body engagable with the switch means operable to actuate the switch means when the finger engages the ramp portion of the sleeve means, biasing means engagable with the body for biasing the finger toward the adjacent sleeve means, and cap means mounted on the head to retain the body and biasing means in assembled relation with the head.

21. The apparatus of claim 20 including: bracket means mounted on the heads, and means connecting the switch means to the bracket means in alignment with the linear motion transfer means, said latter means being adjustable whereby the position of the switch means relative to the linear motor transfer means can be adjusted to alter the actuation time of the switch means to change the amount of movement of the second means.

22. The apparatus of claim 19 wherein: the second means has recess means on opposite sides thereof, said first and second sleeve means each having an annular flange located in one of the recess means, means secured to the second means to retain the flange in said recess means, said flange being smaller than the recess means whereby said piston members have limited lateral movement relative to the second means.

23. The apparatus of claim 22 wherein: the means secured to the second means comprises an annular ring engagable with the flange to hold the flange in the recess means.

24. The apparatus of claim 19 wherein: the first and second inlet valves each have a body having a pocket and at least one passage open to the pocket, the pumping chamber, and the inlet passage, an annular seat surrounding the inlet passage open to the pocket, a valving member located in said pocket movable generally parallel to the longitudinal axis of the pumping chamber between open and closed positions to allow hydraulic fluid to flow into the pumping chamber and block the flow of hydraulic fluid back into the inlet passage, said valving member having a surface engagable with the annular seat to close the inlet passage.

25. The apparatus of claim 24 wherein: said body has a hole open to the center of the pocket, said valving member includes a stem extended through said hole to guide said valving member for movement in said pocket between open and closed positions of the valving member.

26. An apparatus for increasing the pressure of hydraulic fluid and to deliver ultra high pressure flow of hydraulic fluid comprising: first means having an internal chamber, second means movably located in said chamber for reciprocating movement within the internal chamber, third means for selectively causing said second means to reciprocate in said chamber, said third means including fourth means controlled with solenoid means for reversing the movement of the second means, a first head mounted on the first means having a first passage open to said chamber, a second head mounted on the first means having a second passage open to said chamber, a first piston member connected to the second means and extended through the first passage, a second piston member connected to the second means and extended through the second passage member, a first housing having a first pumping chamber mounted on the first head having a longitudinal axis parallel to the longitudinal axis of the first piston member, said first piston member extended into the first pumping chamber, first inlet valve means for allowing hydraulic fluid to flow from a first fluid inlet passage into the first pumping chamber and preventing hydraulic fluid to flow out of the first pumping chamber back into the fluid inlet passage, a first outlet valve means for allowing hydraulic fluid to flow out of the pumping chamber and preventing high pressure hydraulic fluid to flow back into the first pumping chamber, a second housing having a second pumping chamber mounted on the second head having a longitudinal axis parallel to the longitudinal axis of the second piston member, said second piston member extended into the second pumping chamber, second inlet valve means for allowing hydraulic fluid to flow from a second fluid inlet passage into the second pumping chamber, the first and second inlet valves each have a body having a pocket and at least one passage open to the pocket, the pumping chamber, and the inlet passage, an annular seat surrounding the inlet passage open to the pocket, a valving member located in said pocket movable generally parallel to the longitudinal axis of the pumping chamber between open and closed positions to allow hydraulic fluid to flow into the pumping chamber and block the flow of hydraulic fluid back into the inlet passage, said valving member having surface engagable with the annular seat to close the inlet passage, said body having a hole open to the center of the pocket, said valving member includes a stem extended through said hole to guide said valving member for movement in said pocket between open and closed positions of the valving member, said valving member having arcuate corner portions located adjacent a cylindrical wall in said body surrounding said pocket, said corner portions cooperating with said cylindrical wall and said stem cooperating with a wall forming the hole to guide said valving member for movement between open and closed positions of the valving member, and control means responsive to reciprocating movements of the first and second piston members to actuate the fourth means to reverse the movement of the second means whereby the second means reciprocate the piston members to pump hydraulic fluid into and out of the first and second pumping chambers to deliver an ultra high pressure flow of hydraulic fluid.

27. The apparatus of claim 26 wherein: said passage in the body has a cross sectional area smaller than the cross sectional area of the inlet passage.

28. An apparatus for increasing the pressure of hydraulic fluid and to deliver ultra high pressure flow of output hydraulic fluid to means for using ultra high pressure fluid having a piston and cylinder assembly having a cylinder with an internal chamber and a piston located in said chamber for reciprocating movement therein, means for selectively supplying fluid under pressure and venting fluid from the chamber on opposite sides of the piston to reciprocate said piston in said chamber, means mounted on said piston and cylinder assembly having a passage open to said chamber and a pumping chamber, a piston member connected to the piston and extended though said passage with a forward end thereof located within said pumping chamber, a housing mounted on the means mounted on the piston and cylinder assembly, said housing having a fluid inlet passage having a cross sectional area and an outlet end for carrying fluid to the pumping chamber, hydraulic fluid inlet valve means for allowing hydraulic fluid to flow from the fluid inlet passage into the pumping chamber and preventing hydraulic fluid to flow out of the pumping chamber back into said fluid inlet passage, hydraulic fluid outlet valve means for allowing hydraulic fluid under pressure to flow out of the pumping chamber and preventing high pressure hydraulic fluid to flow back into the pumping chamber, and control means responsive to reciprocating movement of the piston member to reverse the flow of fluid under pressure to the chamber on opposite sides of the piston whereby the piston reciprocates the piston member to pump hydraulic fluid into and out of the pumping chamber characterized by the inlet valve means having a body with a pocket, said body being located within the pumping chamber and mounted on the housing to close the pocket, and said body having at least one passage open to the pocket and the pumping chamber, said pocket being open to the fluid inlet passage, said one passage having a cross sectional area smaller than the cross sectional area of the fluid inlet passage, the outlet end of the fluid inlet passage being surrounded by a valve seat exposed to the pocket, a valving member located in said pocket movable only in response to the flow of fluid in said pocket generally parallel to the longitudinal axis of the pumping chamber between open and closed positions to allow hydraulic fluid to flow into the pumping chamber and block the flow of hydraulic fluid back into the fluid inlet passage, said valving member having a surface engageable with the seat to close said fluid inlet passage and arcuate portions located adjacent a cylindrical wall in said body surrounding said pocket, said arcuate portions cooperating with said cylindrical wall to guide the valving member for movement between open and closed positions of the valving member relative to the valve seat.

29. The apparatus according to claim 28 characterized by said body having a hole open to the center of the pocket, said valving member includes a stem extended through said hole to guide said valving member for movement in said pocket.

30. The apparatus according to claim 28 characterized by said valve seat being a flat annular surface on said housing surrounding the outlet end of the inlet passage open to said pocket, said valving member having a flat surface located in surface engagement with said flat annular surface to close the fluid inlet passage.

31. The apparatus according to claim 30 characterized by said housing having a boss projected into the pumping chamber, and means mounting the body on said boss, said boss having said flat annular surface.

32. The apparatus according to claim 28 characterized by said at least one passage open to the pocket and the pumping chamber comprising a plurality of passages open to the pocket and the pumping chamber to allow fluid to flow between said pocket and pumping chamber, said passages having a combined cross sectional area smaller than the cross sectional area of the fluid inlet passage.

33. An apparatus for increasing the pressure of hydraulic fluid and to deliver ultra high pressure flow of output hydraulic fluid to means for using ultra high pressure fluid having a piston and cylinder assembly having a cylinder with an internal chamber and a piston located in said chamber for reciprocating movement therein, means for selectively supplying fluid under pressure and venting fluid from the chamber on opposite sides of the piston to reciprocate said piston in said chamber, means mounted on said piston and cylinder assembly having a passage open to said chamber and a pumping chamber, a piston member connected to the piston and extended though said passage with a forward end thereof located within said pumping chamber, hydraulic fluid inlet valve means for allowing hydraulic fluid to flow into the pumping chamber and preventing hydraulic fluid to flow out of the pumping chamber into a fluid inlet passage, hydraulic fluid outlet valve means for allowing hydraulic fluid to flow out of the pumping chamber and preventing high pressure hydraulic fluid to flow back into the pumping chamber, and control means responsive to reciprocating movement to the piston member to reverse the flow of fluid under pressure to the chamber on opposite sides of the piston whereby the piston reciprocates the piston member to pump hydraulic fluid into and out of the pumping chamber characterized by the inlet valve means having a body with a pocket, and at least one passage open to the pocket, the pumping chamber, and the inlet passage, the inlet passage being surrounded by a valve seat, a valving member located in said pocket movable generally parallel to the longitudinal axis of the pumping chamber between open and closed positions to allow hydraulic fluid to flow into the pumping chamber and block the flow of hydraulic fluid back into the inlet passage, said valving member having a surface engageable with the seat to close said inlet passage, said body having a hole open to the center of the pocket, said valving member includes a stem extended through said hole to guide said valving member for movement in said pocket, said valving member having arcuate corner portions located adjacent a cylindrical wall in said body surrounding said pocket, said corner portions cooperating with said cylindrical wall and said stem cooperating with a wall forming the hole to guide said valving member for movement between open and closed positions of the valving member.

34. The apparatus according to claim 33 characterized by said one passage having a cross sectional area smaller than the cross sectional area of the inlet passage.

35. An apparatus for increasing the pressure of hydraulic fluid and to deliver ultra high pressure flow of output hydraulic fluid to means for using ultra high pressure fluid having a piston and cylinder assembly having a cylinder with an internal chamber and a piston located in said chamber for reciprocating movement therein, means for selectively supplying fluid under pressure and venting fluid from the chamber on opposite sides of the piston to reciprocate said piston in said chamber, means mounted on said piston and cylinder assembly having a passage open to said chamber and a pumping chamber, a piston member connected to the piston and extended though said passage with a forward end thereof located within said pumping chamber, hydraulic fluid inlet valve means for allowing hydraulic fluid to flow into the pumping chamber and preventing hydraulic fluid to flow out of the pumping chamber into a fluid inlet passage, hydraulic fluid outlet valve means for allowing hydraulic fluid to flow out of the pumping chamber and preventing high pressure hydraulic fluid to flow back into the pumping chamber, and control means responsive to reciprocating movement to the piston member to reverse the flow of fluid under pressure to the chamber on opposite sides of the piston whereby the piston reciprocates the piston member to pump hydraulic fluid into and out of the pumping chamber characterized by the inlet valve means having a body with a pocket, and at least one passage open to the pocket, the pumping chamber, and the inlet passage, the inlet passage being surrounded by a valve seat, a valving member located in said pocket movable generally parallel to the longitudinal axis of the pumping chamber between open and closed positions to allow hydraulic fluid to flow into the pumping chamber and block the flow of hydraulic fluid back into the inlet passage, said valving member having a surface engageable with the seat to close said inlet passage, and sleeve means on the piston member, said sleeve means having a ramp portion inclined towards the longitudinal axis of the piston member, said control means including reversing means to change the direction of the flow of fluid under pressure to the chamber on opposite sides of said piston, and means engageable with the ramp portion of the sleeve means to control the reversing means for supplying hydraulic fluid under pressure to the chamber on opposite sides of the piston when the piston is moved to a position adjacent the means engageable with the ramp thereby reversing the flow of hydraulic fluid to the chamber to opposite sides of the piston.

36. The apparatus according to claim 35 characterized by said means engageable with the ramp portion having motion transfer means including a finger adapted to be engaged by the ramp portion to actuate the reversing means to change the direction of the flow of hydraulic fluid under pressure to the chamber on opposite sides of the piston, said motion transfer means comprising body located in a bore in the means mounted on said piston and cylinder assembly, said finger being secured to the body, a rod attached to the body and moveable with said body to actuate the reversing means for changing the direction of the flow of fluid under pressure to the chamber on opposite sides of the piston, biasing means engageable with the body for biasing the finger toward the adjacent sleeve means, and cap means mounted on the means to retain the body and biasing means in assembled relation with the means mounted on said piston and cylinder assembly.

37. The apparatus according to claim 36 characterized by bracket means mounted on the means mounted on said piston and cylinder assembly, connecting a reversing switch means to the bracket means in alignment with the motion transfer means, said last means being adjustable whereby the position of the reversing switch means relative to the motion transfer means can be adjusted to alter the actuation time of the reversing switch means.

38. The apparatus according to claim 35 characterized by the piston having a recess, said sleeve means having an annular flange located in said recess, means secured to the piston to retain the annular flange in said recess, said annular flange being smaller than the recess whereby said piston member has limited laterial movement relative to the piston.

39. The apparatus according to claim 38 characterized by the piston having a recess, said sleeve means having an annular flange located in said recess, means secured to the piston to retain the annular flange in said recess, said annular flange being smaller than the recess whereby said piston member has limited lateral movement relative to the piston.

40. The apparatus according to claim 39 characterized by the means secured to the piston comprises an annular ring engagable with the annular flange to hold the annular flange in the recess.

41. An apparatus for increasing the pressure of hydraulic fluid and to deliver ultra high pressure flow of output hydraulic fluid comprising: a piston, a power means having reciprocating means connected to the piston to reciprocate said piston, means having a pumping chamber, said piston having a forward end located within said pumping chamber, a housing mounted on the means having the pumping chamber, said housing having a fluid inlet passage having a cross sectional area and an outlet end for carrying fluid to the pumping chamber, hydraulic fluid inlet valve means for allowing hydraulic fluid to flow from the fluid inlet passage into the pumping chamber and preventing hydraulic fluid to flow out of the pumping chamber back into said fluid inlet passage, hydraulic fluid outlet valve means for allowing hydraulic fluid under pressure to flow out of the pumping chamber and preventing high pressure hydraulic fluid to flow back into the pumping chamber during reciprocating movements of the piston within said pumping chamber, said inlet valve means having a body with a pocket, said body being located within the pumping chamber and mounted on the housing to close the pocket, said body having a hole open to the center of the pocket and at least one passage open to the pocket and the pumping chamber to allow fluid to flow between the pocket and the pumping chamber, said pocket being open to the fluid inlet passage, the outlet end of the fluid inlet passage being surrounded by a valve seat exposed to the pocket, a valving member located in said pocket movable only in response to the flow of fluid in said pocket generally parallel to the longitudinal axis of the pumping chamber between open and closed positions relative to the valve seat to allow fluid to flow through the pocket and into the pumping chamber and block the flow of hydraulic fluid back into the fluid inlet passage, said valving member having a surface engagable with the seat to close said fluid inlet passage, a stem extended though said hole in the body, and arcuate portions located adjacent a cylindrical wall in said body surrounding said pocket, said arcuate portions cooperating with said cylindrical wall and said stem cooperating with a wall forming said hole open to the center of the pocket to guide said valving member for movement between open and closed positions of the valving member.

42. The apparatus of claim 41 wherein: said one passage has a cross sectional area smaller than the cross sectional area of the fluid inlet passage.

43. The apparatus of claim 41 wherein: said valve seat comprises a flat annular surface on said housing surrounding the outlet end of the inlet passage open to said pocket, said valving member having a flat surface located in surface engagement with the flat annular surface to close the fluid inlet passage.

44. The apparatus of claim 43 wherein: said housing has a boss projected into the pumping chamber, and means mounting the body on said boss, said boss having said flat annular surface.

45. The apparatus of claim 41 wherein: said at least one passage open to the pocket and the pumping chamber comprises a plurality of passages open to the pocket and the pumping chamber to allow fluid to flow between said pocket and pumping chamber.

46. The apparatus of claim 45 wherein: said plurality of passages have a combined cross sectional areas smaller than the cross sectional area of the fluid inlet passage.

* * * * *